US011235961B2

(12) United States Patent
Awa et al.

(10) Patent No.: US 11,235,961 B2
(45) Date of Patent: Feb. 1, 2022

(54) HEIGHT ADJUSTMENT ASSISTANCE DEVICE, CRANE COMPRISING SAME, AND HEIGHT ADJUSTMENT METHOD

(71) Applicant: KOBELCO CONSTRUCTION MACHINERY CO., LTD., Hiroshima (JP)

(72) Inventors: Hidehiro Awa, Hyogo (JP); Takahiro Iwazawa, Hyogo (JP); Jumpei Yamada, Hyogo (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 19 days.

(21) Appl. No.: 16/959,855

(22) PCT Filed: Jan. 10, 2019

(86) PCT No.: PCT/JP2019/000455
§ 371 (c)(1),
(2) Date: Jul. 2, 2020

(87) PCT Pub. No.: WO2019/139066
PCT Pub. Date: Jul. 18, 2019

(65) Prior Publication Data

US 2021/0139297 A1 May 13, 2021

(30) Foreign Application Priority Data

Jan. 12, 2018 (JP) ..... JP2018-003279

(51) Int. Cl.
*B66C 23/76* (2006.01)
*B66C 13/18* (2006.01)
(Continued)

(52) U.S. Cl.
CPC ..... *B66C 23/76* (2013.01); *B66C 13/16* (2013.01); *B66C 13/18* (2013.01); *B66C 13/44* (2013.01);
(Continued)

(58) Field of Classification Search
CPC ..... B66C 23/76; B66C 23/905; B66C 13/18; B66C 13/44; B66C 2700/0392
See application file for complete search history.

(56) References Cited

U.S. PATENT DOCUMENTS 4,557,390 A 12/1985 Mick
2005/0098520 A1 5/2005 Frankenberger et al.
(Continued)

FOREIGN PATENT DOCUMENTS

CN 103693559 A 4/2014
CN 203740920 U 7/2014
(Continued)

OTHER PUBLICATIONS

JP 2017043430 Machine Translation (Year: 2017).*
(Continued)

*Primary Examiner* — Michael R Mansen
*Assistant Examiner* — Juan J Campos, Jr.
(74) *Attorney, Agent, or Firm* — Oblon, McClelland, Maier & Neustadt, L.L.P.

(57) ABSTRACT

A height adjustment assistance device includes an initial state determination part for determining whether a suspended cargo has been lifted from a ground at a start of lifting work, a height detection part for detecting a height of a counterweight from the ground, a storage part for storing an initial height, a calculation part for calculating a target value for correcting the height of the counterweight from the ground based on the initial height and a post-work height, a notification part for notifying an operator of information
(Continued)

regarding the target value, and a length adjustment device for adjusting a length of a hanging member by operating in a manner to change the length of the hanging member extending from a tip of a mast to the counterweight.

11 Claims, 4 Drawing Sheets

(51) Int. Cl.

| | |
|---|---|
| ***B66C 13/44*** | (2006.01) |
| ***B66C 23/90*** | (2006.01) |
| ***B66C 13/16*** | (2006.01) |
| ***B66C 23/36*** | (2006.01) |

(52) U.S. Cl.
CPC ..... *B66C 23/36* (2013.01); *B66C 23/905* (2013.01); *B66C 2700/0371* (2013.01); *B66C 2700/0392* (2013.01)

(56) References Cited

U.S. PATENT DOCUMENTS

| | | | | |
|---|---|---|---|---|
| 2011/0192815 | A1 | 8/2011 | Kurotsu | |
| 2015/0210514 | A1 | 7/2015 | Albinger et al. | |
| 2020/0407201 | A1* | 12/2020 | Windbacher | B66C 23/76 |

FOREIGN PATENT DOCUMENTS

| | | | |
|---|---|---|---|
| CN | 106744393 | A | 5/2017 |
| EP | 3 075 701 | A1 | 10/2016 |
| JP | 9-165191 | A | 6/1997 |
| JP | 11 -49484 | A | 2/1999 |
| JP | 2011-162306 | A | 8/2011 |
| JP | 2017-43430 | A | 3/2017 |

OTHER PUBLICATIONS

Combined Chinese Office Action and Search Report dated Jun. 29, 2021 in Chinese Patent Application No. 201980007320.0 (with English translation), 17 pages Extended European Search Repon dated Feb. 22, 2021 in corresponding European Patent Application No. 19738049.6, 10 pages International Search Report dated Mar. 12, 2019 in PCT/JP2019/000455 filed on Jan. 10, 2019, 1 page.

* cited by examiner

HEIGHT ADJUSTMENT ASSISTANCE DEVICE, CRANE COMPRISING SAME, AND HEIGHT ADJUSTMENT METHOD

TECHNICAL FIELD

The present invention relates to a crane including a counterweight.

BACKGROUND ART

For example, Patent Literature 1 and Patent Literature 2 each disclose a crane that includes a lower traveling body, an upper slewing body mounted on the lower traveling body so as to be slewable, a boom attached to the upper slewing body so as to be raisable and lowerable, a mast which is attached to the upper slewing body and supports the boom in the rearward, and a counterweight suspended from a tip of the mast.

At the start of lifting work by the crane, when a suspended cargo supported by a rope hanging down from a tip of a jib member is lifted up from the ground, the counterweight supported by a guy line hanging down from the tip of the mast is floated from the ground. This achieves a balance of the entire crane.

In the actual lifting work, for example, in order to increase the working radius of the crane, operation of inclining the jib member forward and inclining the mast rearward is performed, and in order to move the suspended cargo in the slewing direction, slewing operation of slewing the upper slewing body is performed.

Meanwhile, when the slewing operation of the upper slewing body is performed, the counterweight is sometimes in a location different, in height above the ground, from the location of the counterweight at the start of the lifting work. Further, the operation of inclining the mast changes an angle between the mast and the ground. In these cases, the height of the counterweight from the ground after the lifting work sometimes differs from the height (initial height) at a time when the counterweight is floated from the ground and a balance is achieved at the start of the lifting work. In this way, when there is a difference between the initial height and the height of the counterweight from the ground after the lifting work, when the suspended cargo is lowered and placed on the ground, the counterweight sometimes does not touch the ground or the guy line supporting the counterweight sometimes becomes loose. An operator, therefore, needs to eliminate the difference between the initial height and the height of the counterweight from the ground after the lifting work by performing crane operations such as operation for raising or lowering the mast, operation for adjusting the length from the tip of the mast to the counterweight.

However, the counterweight is disposed behind the upper slewing body, which makes it difficult for the operator to see the counterweight directly. Thus, the crane operation as described above is complicated and difficult operation. Neither Patent Literature 1 nor Patent Literature 2 specifically describes means for eliminating the difference between the initial height and the height of the counterweight from the ground after the lifting work.

CITATION LIST

Patent Literature

Patent Literature 1: JP 2017-043430 A
Patent Literature 2: JP 2011-162306 A

SUMMARY OF INVENTION

The present invention has been made in light of such a problem, and therefore, an object of the present invention is to provide a height adjustment assistance device capable of, in a case where a height of a counterweight from a ground after lifting work is different from an initial height, assisting in adjusting the height of the counterweight from the ground after the lifting work, a crane including the height adjustment assistance device, and a height adjustment method.

A height adjustment assistance device according to the present invention is a device for assisting in adjusting a height of a counterweight, from a ground, suspended from a tip of a mast of a crane through a hanging member after lifting work for a suspended cargo suspended from a jib member of the crane. The height adjustment assistance device includes an initial state determination part, a height detection part, a storage part, a calculation part, a notification part, and a length adjustment device. The initial state determination part determines whether the suspended cargo has been lifted from the ground at a start of the lifting work. The height detection part detects the height of the counterweight from the ground. The storage part stores, as an initial height, the height of the counterweight from the ground detected by the height detection part when the initial state determination part determines that the suspended cargo has been lifted. The calculation part calculates a target value for correcting the height of the counterweight from the ground based on the initial height stored in the storage part and a post-work height that is the height of the counterweight from the ground detected by the height detection part after the lifting work is performed and before the suspended cargo is placed on the ground. The notification part is configured to notify an operator of information regarding the target value. The length adjustment device is configured to adjust a length of the hanging member by operating in a manner to change the length of the hanging member extending from the tip of the mast to the counterweight.

A height adjustment method according to the present invention is a method for adjusting a height of a counterweight, from a ground, suspended from a tip of a mast of a crane through a hanging member after lifting work for a suspended cargo suspended from a jib member of the crane. The height adjustment method includes detecting an initial height that is the height of the counterweight from the ground at a start of the lifting work, detecting a post-work height that is the height of the counterweight from the ground after the lifting work is performed and before the suspended cargo is placed on the ground, determining a target value for correcting the height of the counterweight from the ground based on the initial height and the post-work height, and adjusting, based on the target value, the height of the counterweight from the ground by adjusting a length of the hanging member extending from the tip of the mast to the counterweight.

DESCRIPTION OF EMBODIMENTS

Hereinafter, description is provided, with reference to the drawings, of a height adjustment assistance device according to an embodiment of the present invention, a crane including the height adjustment assistance device, and a height adjustment method.

[Crane]

Figure 1:
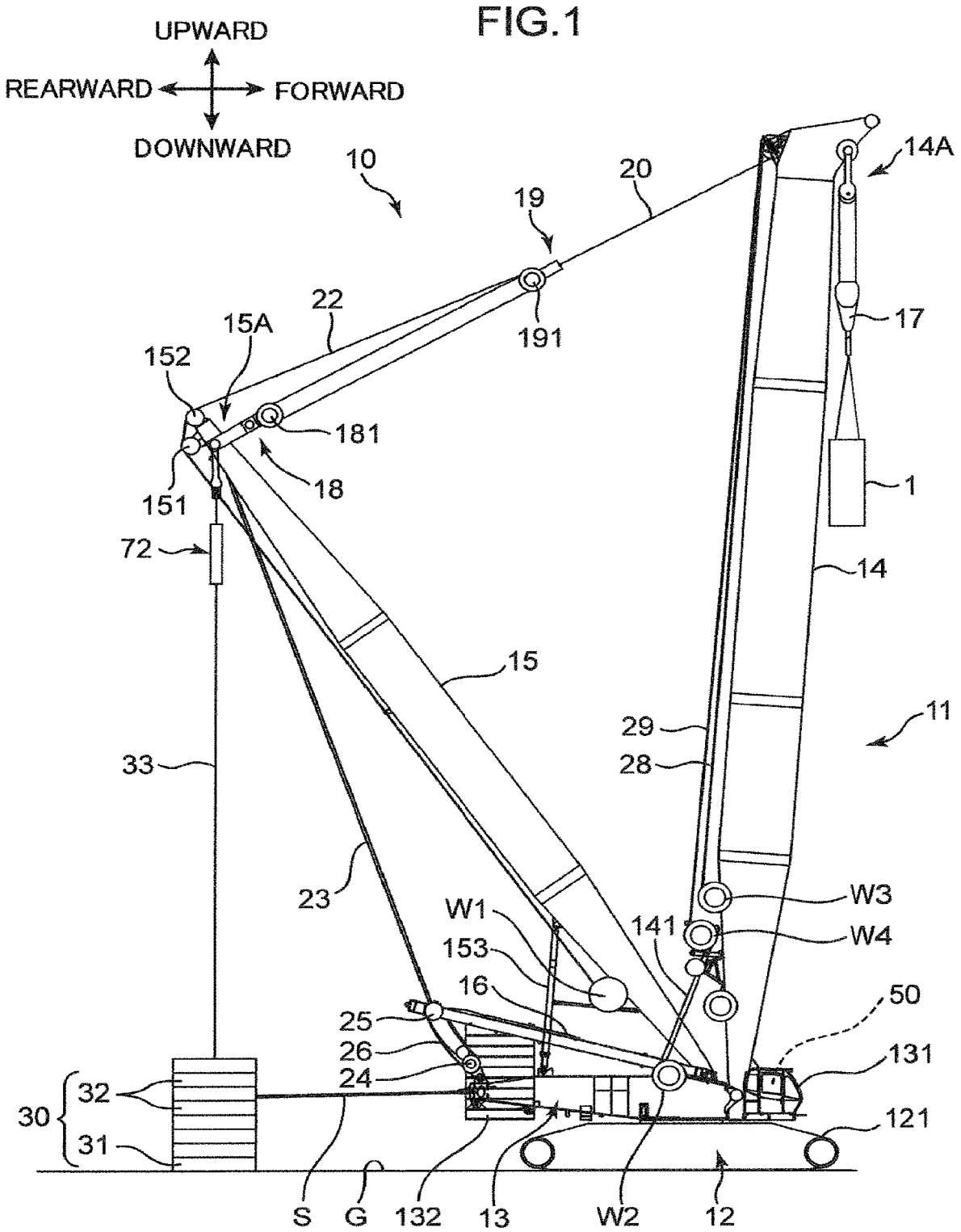
FIG. 1 is a side view showing a crane including a height adjustment assistance device according to an embodiment of the present invention.

FIG. 1 is a side view showing a crane 10 including a height adjustment assistance device 50 according to an embodiment of the present invention. FIG. 1 shows directions of "upward", "downward", "forward", and "rearward"; however, the directions are shown, for the sake of convenience, to describe the structure of the crane 10 according to the embodiment of the present invention, and the directions do not limit a moving direction, a usage mode, and the like of the crane 10.

Figure 2:
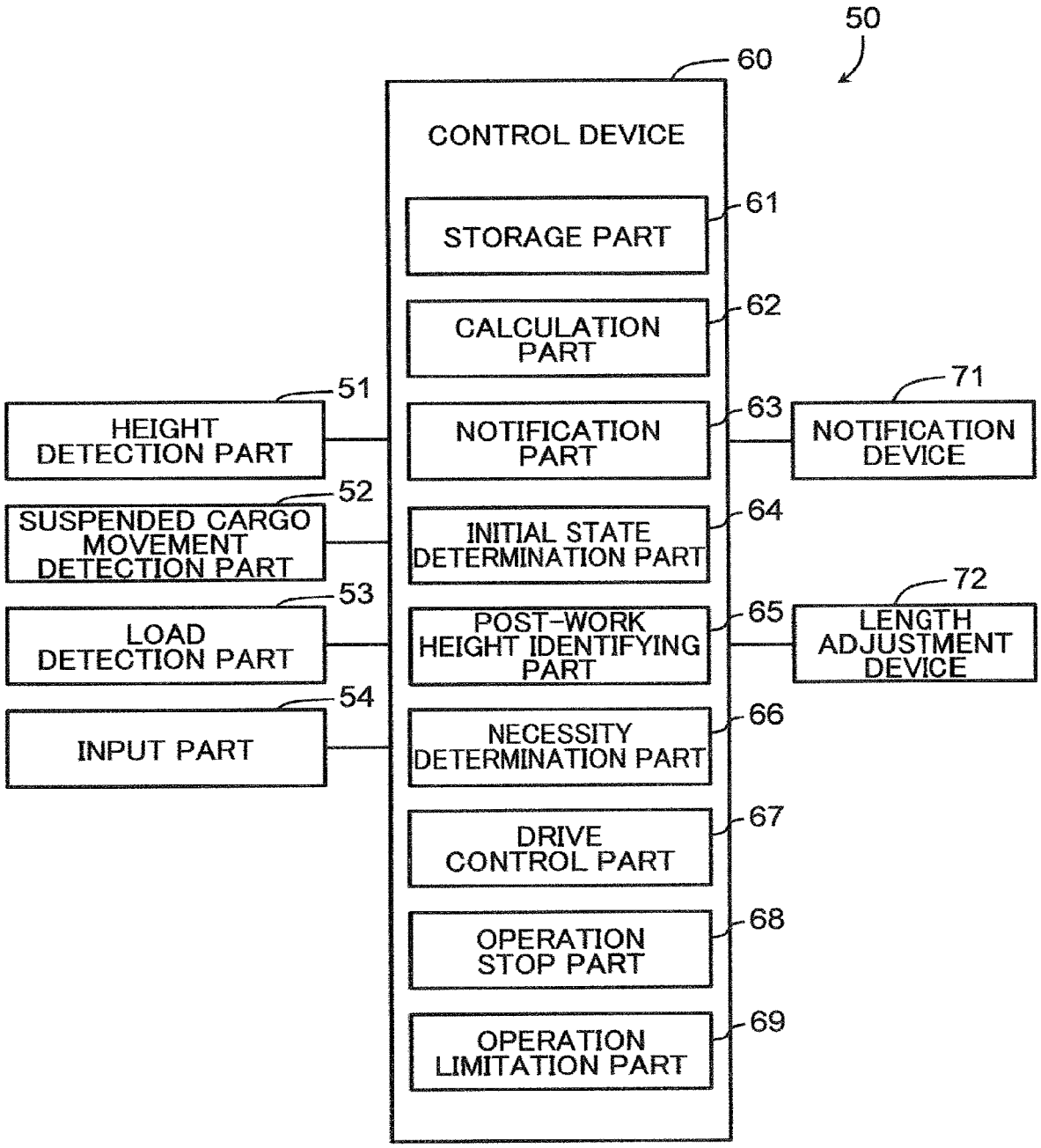
FIG. 2 is a block diagram showing the functional configuration of the height adjustment assistance device according to the embodiment.

As shown in FIG. 1, the crane 10 includes a crane body 11, a counterweight 30, and the height adjustment assistance device 50 (refer to FIG. 2).

The crane body 11 includes a lower traveling body 12, an upper slewing body 13, a boom 14, a mast 15, and a box mast 16. The boom 14 is an example of a jib member in the present invention. The jib member in the present invention includes only the boom 14 according to the present embodiment in one case, and the jib member in the present invention includes the boom and at least one auxiliary jib connected to the tip of the boom in another case.

The lower traveling body 12 can travel on a ground G, and includes a pair of left and right crawlers 121, for example.

The upper slewing body 13 is mounted on the lower traveling body 12. The upper slewing body 13 is configured to be slewable, with respect to the lower traveling body 12, about an axis extending in a direction perpendicular to the ground G on which the lower traveling body 12 travels. The upper slewing body 13 has a cab 131 in which an operator of the crane 10 sits. On the rear of the upper slewing body 13, a counterweight 132 is disposed to adjust a balance of the crane 10. The counterweight 132 is different from a counterweight 30 described later, and is not essential.

The boom 14 is attached to the upper slewing body 13 so as to be raisable and lowerable. The boom 14 includes a base end pivotably supported by the upper slewing body 13 and a tip 14A disposed on the opposite side, in a longitudinal direction, of the base end. Note that the boom 14 shown in FIG. 1 is a so-called lattice boom; however the specific structure of the boom is not limited thereto.

The boom 14 is provided with a pair of left and right backstops 141 on the side of the base end of the boom. The backstops 141 abut on the upper stewing body 13 when the boom 14 is in the upright posture. The abutment suppresses the boom 14 from being swung backward due to high wind or the like.

The mast 15 is attached to the upper slewing body 13 and supports the boom 14 in the rearward. The mast 15 includes a base end and a tip 15A. The base end of the mast 15 is pivotably supported by the upper slewing body 13 about a pivotal axis parallel to a pivotal axis of the boom 14 at a position on the rear side of the boom 14. The mast 15 is pivotable in the same direction as a raising and lowering direction of the boom 14. The mast 15 is provided with a first mast sheave 151 and a second mast sheave 152 on the tip 15A of the mast 15. A boom raising and lowering rope 22, described later, runs across the first mast sheave 151 and the second mast sheave 152.

The mast 15 is supported by a backstop 153 in the rearward. The backstop 153 has a base end attached to the upper slewing body 13 in the rearward of the base end of the mast 15, and a tip attached to a part, in the longitudinal direction, of the mast 15.

The box mast 16 has a rectangular shape in a sectional view. A part on a base end side of the box mast 16 is pivotably coupled to the upper slewing body 13 on the rear side of the mast 15. A pivotal axis of the box mast 16 is disposed so as to be parallel with the pivotal axis of the boom 14, and the box mast 16 is pivotable in the same direction as the raising and lowering direction of the boom 14.

The crane body 11 further includes a lower spreader 18, an upper spreader 19, a guy line 20, the boom raising and lowering rope 22, and a boom raising and lowering winch W1.

The lower spreader 18 is pivotably supported around a shaft support of the tip 15A of the mast 15. The lower spreader 18 includes a plurality of first sheaves 181 arranged in a left-right direction.

The upper spreader 19 is disposed forward of the lower spreader 18 at a predetermined distance therefrom. The upper spreader 19 is connected to the tip 14A of the boom 14 via the guy line 20. The upper spreader 19 includes a plurality of second sheaves 191 arranged in the left-right direction.

The guy lines 20 are composed of a pair of left and right guy lines 20. The guy lines 20 each have a rear end connected to the upper spreader 19 and a front end connected to the tip 14A of the boom 14.

The boom raising and lowering rope 22 is pulled out from the boom raising and lowering winch W1, and runs through the first mast sheave 151 and the second mast sheave 152 at the tip 15A of the mast 15, and then, is looped between the first sheave 181 and the second sheave 191 a plurality of times. Note that the tip of the boom raising and lowering rope 22 which has been looped between the first sheave 181 and the second sheave 191 is fixed to the tip 15A of the mast 15.

The boom raising and lowering winch W1 is disposed on the base end side of the mast 15. The boom raising and lowering winch W1 winds or unwinds the boom raising and lowering rope 22 to change the distance between the first sheave 181 and the second sheave 191, and the boom 14 is raised or lowered while the boom 14 is caused to pivot relatively to the mast 15.

The crane body 11 further includes a guy line 23, a mast raising and lowering rope 26, and a mast raising and lowering winch W2.

The guy lines 23 are composed of a pair of left and right guy lines 23. The guy lines 23 connect the tip 15A of the mast 15 and the tip of the box mast 16 to each other. The connection makes the pivot of the mast 15 and the pivot of the box mast 16 in coordination with each other.

The mast raising and lowering rope 26 is looped a plurality of times between a sheave block 24 and a sheave block 25, the sheave block 24 being disposed on the upper slewing body 13 and including a plurality of sheaves arranged in a width direction, the sheave block 25 being disposed on the tip of the box mast 16 and including a plurality of sheaves arranged in the width direction.

The mast raising and lowering winch W2 is disposed on the base end side of the box mast 16. The mast raising and lowering winch W2 winds or unwinds the mast raising and lowering rope 26. The operation of winding or unwinding of the mast raising and lowering winch W2 changes the distance between the sheave block 25 on the tip of the box mast 16 and the sheave block 24 on the rear end of the upper slewing body 13, and the mast 15 is raised or lowered while the box mast 16 and the mast 15 integrally pivot relatively to the upper slewing body 13. Note that the mast 15 and the box mast 16 pivot mainly when the crane 10 is assembled and disassembled, and the position (angle to the ground) of the mast 15 and the position (angle to the ground) of the box mast 16 are almost fixed when the crane 10 is used.

In addition to the mast raising and lowering winch W2 and the boom raising and lowering winch W1 as described above, a main winding winch W3 and an auxiliary winding winch W4 for winding up and down the suspended cargo 1 are mounted on the crane body 11.

The main winding winch W3 winds up and down the suspended cargo 1 with a main winding rope 28. As for the main winding, a non-illustrated main winding guide sheave is rotatably provided on the tip 14A of the boom 14, and further, a main winding sheave block in which a plurality of main winding point sheaves are arranged in the width direction is provided at a position adjacent to the main winding guide sheave. A main hook 17 for the suspended cargo is coupled to the main winding rope 28 hanging down from the main winding sheave block. Then, the main winding rope 28 pulled out from the main winding winch W3 runs through the main winding guide sheave in order, and is looped between the sheaves of the main winding sheave block and sheaves of the sheave block provided in the main hook 17. Accordingly, when the main winding winch W3 winds or unwinds the main winding rope 28, winding up or down of the main hook 17 is performed.

Similarly, the auxiliary winding winch W4 winds up and down the suspended cargo 1 with an auxiliary winding rope 29. As for the auxiliary winding, a non-illustrated structure is provided which is similar to the case of the main winding described above. In response to the auxiliary winding winch W4 winding or unwinding the auxiliary winding rope 29, a non-illustrated auxiliary hook for the suspended cargo, which is coupled to the end of the auxiliary winding rope 29, is wound up or down.

The counterweight 30 is so provided that the crane body 11 lifts a heavy object, and has a function to adjust the balance of the crane 10. The counterweight 30 has a pallet 31 and one or more weights 32 loaded on the pallet 31. Note that the counterweight 30 is not limited thereto, and may include, for example, a non-illustrated cart and one or more weights 32 loaded on the cart. Alternatively, the counterweight 30 may consist of one or more weights 32.

As shown in FIG. 1, the counterweight 30 is disposed rearward of the upper stewing body 13. The counterweight 30 is connected to the rear of the upper stewing body 13 by a coupling member S. The coupling member S may be, for example, a wire, a coupling beam with rigidity, and a telescopic beam capable of adjusting the distance between the upper slewing body 13 and the counterweight 30; however is not limited thereto. In a case where the coupling member S is a coupling beam with rigidity or a telescopic beam with rigidity, it is preferable that the coupling member S is formed to be pivotable with respect to the upper slewing body 13 on the base end of the coupling member S connected to the rear of the upper stewing body 13.

The counterweight 30 is suspended from the tip 15A of the mast 15 via a guy line 33 (guy link 33) and a length adjustment device 72 so as to balance the boom 14. The lower end of the guy line 33 is attached to the counterweight 30. The length adjustment device 72 is described later. In this embodiment, the guy line 33 and the length adjustment device 72 constitute a hanging member, and the counterweight 30 is suspended from the tip 15A of the mast 15 via the hanging member. The counterweight 30 is suspended from the tip 15A of the mast 15 at the rearward of the tip 14A of the boom 14 from which the suspended cargo 1 is suspended.

[Height Adjustment Assistance Device]

The height adjustment assistance device 50 according to the embodiment is a device for assisting in adjusting, in a case where a height of the counterweight 30 from the ground G after lifting work (post-work height h2) is different from a height of the counterweight 30 from the ground G at the start of the lifting work (initial height h1), the post-work height h2. The height adjustment assistance device 50 is provided in the crane 10.

FIG. 2 is a block diagram showing the functional configuration of the height adjustment assistance device 50 according to the embodiment. The height adjustment assistance device 50 includes a control device 60. The control device 60 is configured of a central processing unit, ROM (a read only memory) for storing a variety of control programs, RAM (a random access memory) used as a work area of the CPU, and the like.

The height adjustment assistance device 50 includes a height detection part 51, a suspended cargo movement detection part 52, a load detection part 53, an input part 54, a notification device 71, and the length adjustment device 72. Further, the control device 60 of the height adjustment assistance device 50 includes, as functions, a storage part 61, a calculation part 62, a notification part 63, an initial state determination part 64, a post-work height identifying part 65, a necessity determination part 66, a drive control part 67, an operation stop part 68, and an operation limitation part 69.

In response to the CPU executing the control program, the control device 60 operates such that the storage part 61, the calculation part 62, the notification part 63, the initial state determination part 64, the post-work height identifying part 65, the necessity determination part 66, the drive control part 67, the operation stop part 68, the operation limitation part 69, and the like are configured functionally. The control device 60 executes the control program based on signals input from the height detection part 51, the suspended cargo movement detection part 52, the load detection part 53, the input part 54, and the like to control the operation of the notification device 71, the length adjustment device 72, and the like.

The initial state determination part 64 has a function to determine whether the suspended cargo 1 has been lifted from the ground G at the start of lifting work. The initial state determination part 64 is to determine a time at which the height detection part 51, described later, detects the initial height. At the start of lifting work, when the suspended cargo 1 suspend from the tip 14A of the boom 14 is floated from the ground G, usually, the counterweight 30 suspended from the tip 15A of the mast 15 is also floated from the ground G to the initial height h1. Accordingly, the initial state determination part 64 can determine indirectly whether the counterweight 30 is in contact with the ground G by determining whether the suspended cargo 1 has been lifted from the ground G.

The load detection part 53 is to detect a load related to the suspended cargo 1. Specifically, the load detection part 53 is to detect a load applied, by the suspended cargo 1, to the tip 14A of the boom 14 (an example of a tip of the jib member). A signal related to the load detected by the load detection part 53 is input to the control device 60 and is stored into the storage part 61. The load detection part 53 may be, for example, a load cell that is a device to convert loads into electrical signals. The load detection part 53 is provided at a position where the load of the suspended cargo 1 can be detected. The load detection part 53 is provided, for example, in the winch W3, the tip 14A of the boom 14, the hook 17, or the like.

When the signal related to the load of the suspended cargo 1 detected by the load detection part 53 is input to the control device 60, the initial state determination part 64 determines, based on the signal, whether the suspended cargo 1 has been lifted from the ground G. Specifically, when the winch W3 winds the rope 28 in a state where the suspended cargo 1 is placed on the ground G (state where the suspended cargo 1 completely contacts the ground G), operation for raising the suspended cargo 1 attached to the hook 17 is started. When the raising operation is started, the load detected by the load detection part 53 gradually increases. When the suspended cargo 1 is completely floated from the ground G, the load detected by the load detection part 53 is stabilized at a certain value and does not increase any more. The initial state determination part 64 can thus determine that the suspended cargo 1 has been lifted from the ground G, for example, when the load detected is stabilized.

The height detection part 51 is to detect the height of the counterweight 30 from the ground G. The height detection part 51 may be, for example, an infrared distance sensor or an ultrasonic distance sensor. It is only required that the height detection part 51 is configured to measure a height of the counterweight 30 from the ground G, namely, a distance between the bottom of the counterweight 30 and the ground G, and the height detection part 51 is not limited to such distance sensors described above.

The storage part 61 has a function to store a plurality of heights of the counterweight 30 from the ground G. Specifically, when a signal related to a height of the counterweight 30 from the ground G detected by the height detection part 51 is input to the control device 60, the storage part 61 stores data on the signal. For example, the storage part 61 stores the initial height h1 that is a height, from the ground G, of the counterweight 30 detected by the height detection part 51 when the initial state determination part 64 determines that the suspended cargo 1 has been lifted. The storage part 61 also stores the post-work height h2 that is a height, from the ground G, of the counterweight 30 detected by the height detection part 51 after lifting work.

The calculation part 62 has a function to calculate a target value Δh for correcting the height of the counterweight 30 from the ground G based on the initial height h1 and the post-work height h2 stored in the storage part 61. The target value Δh may be a value (Δh=h1−h2) obtained by, for example, subtracting the post-work height h2 from the initial height h1 and obtaining the difference therebetween. The target value Δh calculated by the calculation part 62 is stored into the storage part 61.

The notification part 63 has a function to notify the operator of information regarding the target value Δh. When and how many times the notification part 63 notifies the operator of information regarding the target value Δh is not particularly limited. For example, the notification part 63 can notify the operator of information regarding the target value Δh once or a plurality of times after the post-work height h2 is detected and the target value Δh is calculated. Alternatively, the notification part 63 may always notify the operator of information regarding the target value Δh. Specifically, since the post-work height h2 gradually approaches the initial height h1 when correction is being made to the post-work height h2 after the lifting work is finished, the target value Δh gradually reduces. The notification part 63 can also notify the operator of such a change in the target value Δh continuously.

In the present embodiment, the notification part 63 notifies the operator of information regarding the target value Δh via the notification device 71. The notification device 71 is so configured that the operator can recognize information regarding the target value Δh through the sense of sight or the sense of hearing of the operator. The notification device 71 as described above may be a display device (for example, a monitor such as a liquid crystal display device) having a function to display letters and graphics which can be recognized by the operator through the sense of sight. Alternatively, the notification device 71 may be a speaker having a function to output sound which can be recognized by the operator through the sense of hearing.

The length adjustment device 72 is configured to adjust the length of the hanging member by operating to change the length of the hanging member extending from the tip 15A of the mast 15 to the counterweight 30. The length adjustment device 72 may be a cylinder 72 (telescopic mechanism 72) such as a hydraulic cylinder. The length of the cylinder 72 is adjustable. The upper end of the cylinder 72 is connected directly or via a guy line to the tip 15A of the mast 15. The lower end of the cylinder 72 is connected to the guy line 33.

When the cylinder 72 is lengthened (the length of the cylinder 72 is increased), the counterweight 30 attached to the lower end of the guy line 33 moves downward. When the cylinder 72 is shortened (the length of the cylinder 72 is reduced), the counterweight 30 moves upward. The cylinder 72 is lengthened or shortened in this way, which adjusts the length from the tip 15A of the mast 15 to the counterweight 30, so that the height of the counterweight 30 from the ground G can be adjusted.

Note that the length adjustment device 72 is not limited to the cylinder 72 and may be a non-illustrated winch capable of winding and unwinding the guy line 33, for example. The winch winds or unwinds the guy line 33 to adjust the length from the tip 15A of the mast 15 to the counterweight 30, which enables adjustment to the height of the counterweight 30 from the ground G. In a case where the length adjustment device 72 is the winch, of the guy line 33 unwound from the winch, a part extending from the tip 15A of the mast 15 to the counterweight 30 constitutes a hanging member. The counterweight 30 is suspended from the tip 15A of the mast 15 via the hanging member.

The suspended cargo movement detection part 52 has a function to detect operation for adjusting the height of the suspended cargo 1 from the ground G. The suspended cargo movement detection part 52 may be, for example, an encoder capable of detecting the operation of the winch W3. The encoder converts the rotational speed of the winch W3 and the like to electrical signals, and inputs the same to the control device 60. It is only required that the suspended cargo movement detection part 52 can directly or indirectly detect that the suspended cargo 1 is moving upward and moving downward, and the suspended cargo movement detection part 52 is not limited to the encoder described above. The suspended cargo movement detection part 52 may be, for example, an infrared distance sensor or an ultrasonic distance sensor. Such a distance sensor can be provided in the hook 17, the suspended cargo 1, or the like, for example. The suspended cargo movement detection part 52 may be, for example, a sensor capable of detecting operation of an operating lever for operation related to the suspended cargo 1, specifically, an operating lever for operating the winch W3.

The post-work height identifying part 65 has a function to identify the post-work height h2 after the lifting work. Specifically, the post-work height identifying part 65 identifies, as the post-work height h2, the height of the counterweight 30 from the ground G detected by the height detection part 51 when a condition that the suspended cargo movement detection part 52 detects operation for reducing the height of the suspended cargo 1 from the ground G and the load detection part 53 detects reduction in load related to the suspended cargo 1 is satisfied. The post-work height identifying part 65 identifies the post-work height h2 at a time when the control device 60 receives inputs of a signal related to operation for reducing the height of the suspended cargo 1 from the ground G detected by the suspended cargo movement detection part 52 and a signal related to reduction in load of the suspended cargo 1 detected by the load detection part 53.

Conditions under which the post-work height identifying part 65 identifies the post-work height h2 include: detecting, by the suspended cargo movement detection part 52, operation for reducing the height of the suspended cargo 1 from the ground G; and detecting, by the load detection part 53, reduction in load related to the suspended cargo 1. A case where one of the conditions is detected shows a high possibility that the load is reduced, for example, due to the influence of the wind or a high possibility of temporary retraction operation to avoid an obstacle, for example. On the other hand, a case where both the conditions are detected shows a high possibility that the operator intends to move the suspended cargo 1 downward and it is a moment when a part of the suspended cargo 1 (corner of the suspended cargo 1 or the like) comes into contact with the ground G and the suspended cargo 1 has not yet been placed on the ground G (state before the entire suspended cargo 1 is grounded on the ground G). Thus, the post-work height identifying part 65 can identify, as the post-work height h2, the height of the counterweight 30 from the ground G detected by the height detection part 51 when both the conditions are satisfied.

The drive control part 67 has a function to control drive of the length adjustment device 72 based on the target value Δh to correct the height of the counterweight 30 from the ground G, which makes it possible to correct the post-work height h2 to the initial height h1. Specifically, the drive control part 67 controls the operation of the length adjustment device 72, based on the target value Δh stored in the storage part 61, so that the post-work height h2 approaches the initial height h1. For example, in a case where the length adjustment device 72 is the cylinder 72, the following control is performed. To be specific, since the post-work height h2 is lower than the initial height h1 for a case where the target value Δh (Δh=h1−h2) is a positive value, the drive control part 67 controls the operation of the cylinder 72 to shorten the cylinder 72. On the other hand, since the post-work height h2 is higher than the initial height h1 for a case where the target value Δh is a negative value, the drive control part 67 controls the operation of the cylinder 72 to lengthen the cylinder 72.

The drive control part 67, the suspended cargo movement detection part 52, the load detection part 53, and the post-work height identifying part 65 enable automatic adjustment to the height of the counterweight 30 from the ground G after the lifting work, namely, automatic correction to the post-work height h2. This eliminates the need for the operator to operate the crane 10 to adjust the post-work height h2, leading to reduction of the burden required for the operator to perform the crane operation.

The necessity determination part 66 has a function to determine whether correcting the height of the counterweight 30 from the ground G is necessary based on the target value Δh. The necessity determination part 66 determines whether the correction is necessary based on data related to the target value Δh stored in the storage part 61. The drive control part 67 controls the drive of the length adjustment device 72 based on the target value Δh only in a case where the necessity determination part 66 determines that correcting the height of the counterweight 30 from the ground G is necessary.

The necessity determination part 66 can also determine that correcting the height of the counterweight 30 from the ground G is not necessary on the condition that the target value Δh is 0 (zero), in other words, on the condition that the post-work height h2 is equal to the initial height h1. However, the necessity determination part 66 is preferably configured to determine that correcting the height of the counterweight 30 from the ground G is not necessary in a case where the difference between the initial height h1 and the post-work height h2 falls within a preset range in addition to the case where the difference therebetween is 0 (zero).

Specifically, in a case where the difference between the initial height h1 and the post-work height h2 falls within a constant range having a preset extent as described above, in other words, the difference therebetween falls within an acceptable range in terms of safety and the like, the necessity determination part 66 determines that correcting the height of the counterweight from the ground is not necessary, and the drive control part 67 does not control the drive of the length adjustment device 72. As described above, a certain extent of conditions for determination of the necessity of correction is provided (hysteresis is provided), which avoids excessive control operation. If the condition for determination of the necessity of correction is that the difference between the initial height h1 and the post-work height h2 becomes 0 (zero), the control flow of the height adjustment assistance device 50 does not finish until the difference becomes 0 (zero), which sometimes takes long time to adjust the height. In contrast, in a case where a certain extent of conditions for determination of the necessity of correction is provided, the time required for height adjustment can be shortened with excess control operation avoided.

The operation stop part 68 has a function to stop the operation related to the suspended cargo 1 before the automatic correction. Specifically, for example, the operation stop part 68 controls, before the automatic correction, the winch W3 so that the operation of the winch W3 stops. This can stop the operation of the suspended cargo 1 (moving downward operation, for example).

The input part 54 is to receive, from the operator, an input as to whether the automatic correction to the height of the counterweight 30 from the ground G is necessary. A signal related to data input via the input part 54 is input to the control device 60 and is stored into the storage part 61. Then, when a signal showing that the automatic correction is necessary is input to the control device 60, the drive control part 67 controls the drive of the length adjustment device 72 based on the target value Δh.

The method for inputting the data is not particularly limited; however, the data is input, for example, in the following manner. To be specific, as the input method, a method can be used in which the operator selects, from among options displayed in a display device (input device)

such as an operational panel provided in the crane 10, for example, either "automatic correction required" or "automatic correction not required".

The operation limitation part 69 has a function to limit the operation related to the suspended cargo 1 while the height of the counterweight 30 from the ground G is automatically corrected, and after the height of the counterweight 30 from the ground G is automatically corrected. In order to limit the operation related to the suspended cargo 1, the operation limitation part 69 may limit, for example, operation of the operating lever for operation related to the suspended cargo 1 (operating lever for operating the winch W3), or may limit the operation of the winch W3. Specifically, when correction to the post-work height h2 is started, the operation limitation part 69 can perform control to lock the operating lever so that the operator is not allowed to operate the operating lever, or can control the winch W3 so that the winch W3 does not operate even if the operator operates the operating lever.

For example, in a case where the counterweight 30 is not grounded and is at a high position at a time when the operator performs the operation related to the suspended cargo 1 to lower the suspended cargo 1 during the automatic correction and the suspended cargo 1 is placed on the ground G (state where the entire suspended cargo 1 is grounded on the ground G), a load is applied to the rear of the crane 10. Further, after the automatic correction, in a state where the operation related to the suspended cargo 1 is being performed, the suspended cargo 1 may move in a manner different from the operator's expectation after the automatic correction. Specifically, for example, in a case where the operating lever for operation related to the suspended cargo 1 is not in a neutral position where the suspended cargo 1 is not operated but in an operating position where the suspended cargo 1 is operated at the start of the automatic correction and the operating lever is in the operating position even after the automatic correction, the suspended cargo 1 may move in a manner different from the operator's expectation after the automatic correction.

On the other hand, in the present embodiment, since the operation limitation part 69 limits the operation related to the suspended cargo 1 during and after the automatic correction, it is possible to prevent the suspended cargo 1 from moving in a manner different from the operator's expectation after the automatic correction. This enables safer automatic correction to the post-work height h2.

Further, the operation limitation part 69 is configured to cancel the limitation to the operation related to the suspended cargo 1 when the operation related to the suspended cargo 1 is not performed after the height of the counterweight 30 from the ground G has been automatically corrected. The case where the operation related to the suspended cargo 1 is not performed after the automatic correction means, for example, a case where the operating lever for operation related to the suspended cargo is in the neutral position where the suspended cargo is not operated.

Figure 3:
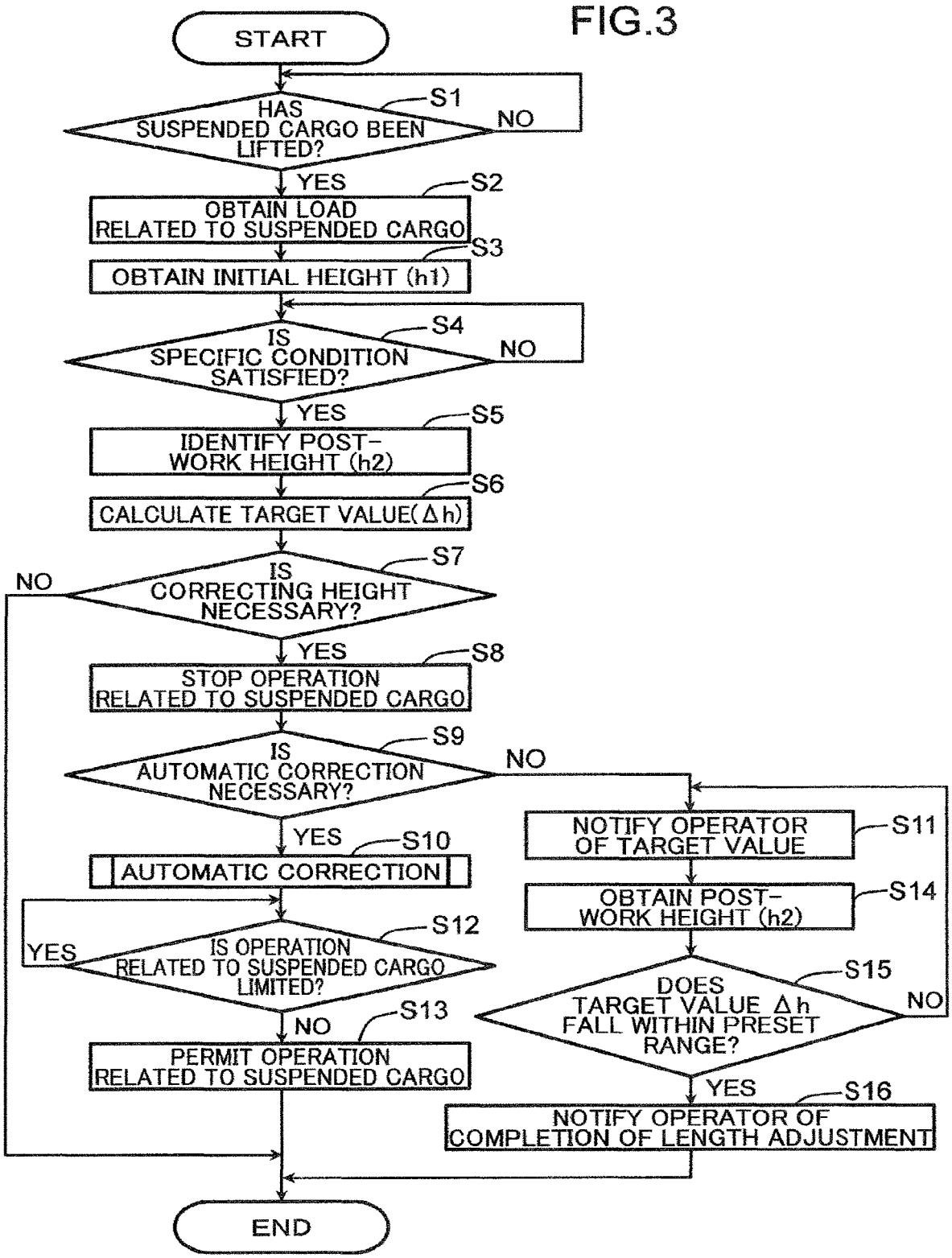
FIG. 3 is a flowchart depicting a height adjustment method in which the height adjustment assistance device according to the embodiment is used.

The description then goes on to specific operation of the height adjustment assistance device 50. FIG. 3 is a flowchart depicting a height adjustment method in which the height adjustment assistance device 50 according to the embodiment is used.

At the start of the lifting work with the crane 10, the operator operates the operating lever to operate the winch W3 to lift the suspended cargo 1, supported by the rope 28 hanging down from the tip 14A of the boom 14, upward from the ground G. Thereby, the counterweight 30 supported by the guy line 33 hanging down from the tip 15A of the mast 15 is floated from the ground G to the initial height h1. This achieves a balance of the entire crane.

As shown in FIG. 3, in a series of the operation at the start described above, the initial state determination part 64 of the height adjustment assistance device 50 determines whether the suspended cargo 1 has been lifted from the ground G based on the signal related to the load of the suspended cargo 1 detected by the load detection part 53 (step S1 of FIG. 3). In a case where the initial state determination part 64 determines that the suspended cargo 1 is not lifted front the ground G (NO in step S1), the determination is repeated. Then, when the initial state determination part 64 determines that the suspended cargo 1 has been lifted from the ground G (YES in step S1), the control device 60 obtains a signal of the load related to the suspended cargo 1 detected at that time by the load detection part 53 (step S2), data related to the signal is stored into the storage part 61 as a weight of the suspended cargo 1.

Further, at a time when the initial state determination part 64 of the control device 60 determines that the suspended cargo 1 has been lifted from the ground G, the initial state determination part 64 obtains a signal related to the height of the counterweight 30 from the ground G detected by the height detection part 51 (step S3), and the control device 60 stores data related to the signal into the storage part 61 as the initial height h1.

Thereafter, in the actual lifting work, raising and lowering operation of the mast 15, operation for adjusting the length from the tip 15A of the mast 15 to the counterweight 30, and the like are performed, so that the counterweight 30 is raised to a sufficient height from the ground G. For example, in order to increase the working radius of the crane 10, operation of inclining the boom 14 forward and operation of inclining the mast 15 rearward are performed, and in order to move the suspended cargo 1 in the slewing direction, slewing operation of slewing the upper slewing body 13 is performed.

After the lifting work in which these operations are performed, the counterweight 30 may be located in a place different from the place where the counterweight 30 has been located at the start of the lifting work. Further, operation of inclining the mast 15 and the like changes the angle between the mast 15 and the ground G. In these cases, the height of the counterweight 30 from the ground G after the lifting work (post-work height h2) is different from the initial height h1 at the start of the lifting work described above. The operator thus needs to return the post-work height h2 to the initial height h1 to avoid a state where the counterweight 30 is not in contact with the ground G and a state where the guy line 33 for supporting the counterweight 30 is loose, after the lifting work and before the suspended cargo 1 is placed on the ground G (before the entire suspended cargo 1 is grounded the ground G).

In the process until the operator places the suspended cargo 1 on the ground G after the lifting work, the suspended cargo 1 is to pass through the following states roughly. To be specific, the suspended cargo 1 passes through a first state, a second state, and a third state in that order. The first state is a state where the suspended cargo 1 is not in contact with the ground G at all. The second state is a state showing a moment at which a part of the suspended cargo 1 comes into contact with the ground G and before the suspended cargo 1 is placed on the ground G (state before the entire suspended cargo 1 is grounded on the ground G). Since the suspended cargo 1 is not in contact with the ground G completely and the suspended cargo 1 is partially floated from the ground G in the second state, the load of the suspended cargo 1 is applied to the rope 28, the hook 17, and the like. The third state is a state where the suspended cargo 1 is placed on the ground G (state where the entire suspended cargo 1 is grounded on the ground G).

The post-work height identifying part 65 identifies (step S4), as the post-work height h2, the height of the counterweight 30 from the ground G detected by the height detection part 51 when a condition that the suspended cargo movement detection part 52 detects operation for reducing the height of the suspended cargo 1 from the ground G and the load detection part 53 detects reduction in load related to the suspended cargo 1 is satisfied. When the suspended cargo 1 is in the first state, the suspended cargo movement detection part 52 detects operation for reducing the height of the suspended cargo 1 from the ground G and the load detection part 53 does not detect the reduction in load related to the suspended cargo 1. Thus, in the first state, it cannot be said that the lifting work has been finished, and thus, the post-work height identifying part 65 does not identify the post-work height h2 (NO in step S4). On the other hand, when the suspended cargo 1 is in the second state, since the condition that the suspended cargo movement detection part 52 detects operation for reducing the height of the suspended cargo 1 from the ground G and the load detection part 53 detects reduction in load related to the suspended cargo 1 is satisfied (YES in step S4), the post-work height identifying part 65 identifies (step S5), as the post-work height h2, the height of the counterweight 30 from the ground G detected at that time by the height detection part 51, and the post-work height h2 is stored into the storage part 61.

Next, the calculation part 62 calculates (step S6) a target value Δh for correcting the height of the counterweight 30 from the ground G based on the initial height h1 stored in the storage part 61 and the post-work height h2 stored in the storage part 61. The target value Δh (Δh=h1−h2) is stored into the storage part 61.

Next, the necessity determination part 66 determines whether correcting the post-work height h2 is necessary based on the data related to the target value Δh stored in the storage part 61 (step S7). The necessity determination part 66 determines (NO in step S7) that correcting the post-work height h2 is not necessary in a case where the difference between the initial height h1 and the post-work height h2 falls within the preset range, and the control device 60 finishes controlling the height adjustment assistance device 50. On the other hand, in a case where the difference between the initial height h1 and the post-work height h2 does not fall within the preset range, the necessity determination part 66 determines (YES in step S7) that correcting the post-work height h2 is necessary.

Next, when the necessity determination part 66 determines that correcting the post-work height h2 is necessary, for example, the operation stop part 68 controls the winch W3 so that the operation of the winch W3 stops, thereby stopping the operation related to the suspended cargo 1 (step S8).

Next, the input part 54 receives, from the operator, an input as to whether automatic correction to the post-work height h2 is necessary (step S9). The operator selects, from among options displayed in the display device such as an operational panel, either "automatic correction required" or "automatic correction not required". If the operator selects "automatic correction not required" (NO in step S9), then a signal related to the input data is input to the control device 60. The notification part 63 then notifies the operator of information regarding the target value Δh (step S11). In such a case, the operator himself/herself operates the crane 10 to return the post-work height h2 to the initial height h1.

The control device 60 then obtains (step S14) a signal related to the height of the counterweight 30 from the ground G (post-work height h2 that has been corrected by the operator) detected by the height detection part 51, and the calculation part 62 calculates a post-correction target value Δh (h1−h2) based on the initial height h1 and the post-work height h2 that has been corrected by the operator. The control device 60 then determines whether the post-correction target value Δh (h1−h2) falls within a preset range (step S15). If the post-correction target value Δh (h1−h2) does not fall within the preset range (NO in step S15), then the processing of steps S11, S14, and S15 is performed again. On the other hand, if the post-correction target value Δh (h1−h2) falls within the preset range (YES in step S15), then the notification part 63 notifies the operator of completion of the height adjustment (length adjustment) (step S16). At this time, the notification part 63 may control the notification device 71 to erase the target value Δh displayed in the notification device 71 such as the display device for example, and may control the notification device 71 to remain the target value Δh displayed.

On the other hand, if the operator selects "automatic correction required" from among the options (YES in step S9), then a signal related to the input data is input to the control device 60 and the following control of automatic correction is carried out.

Figure 4:
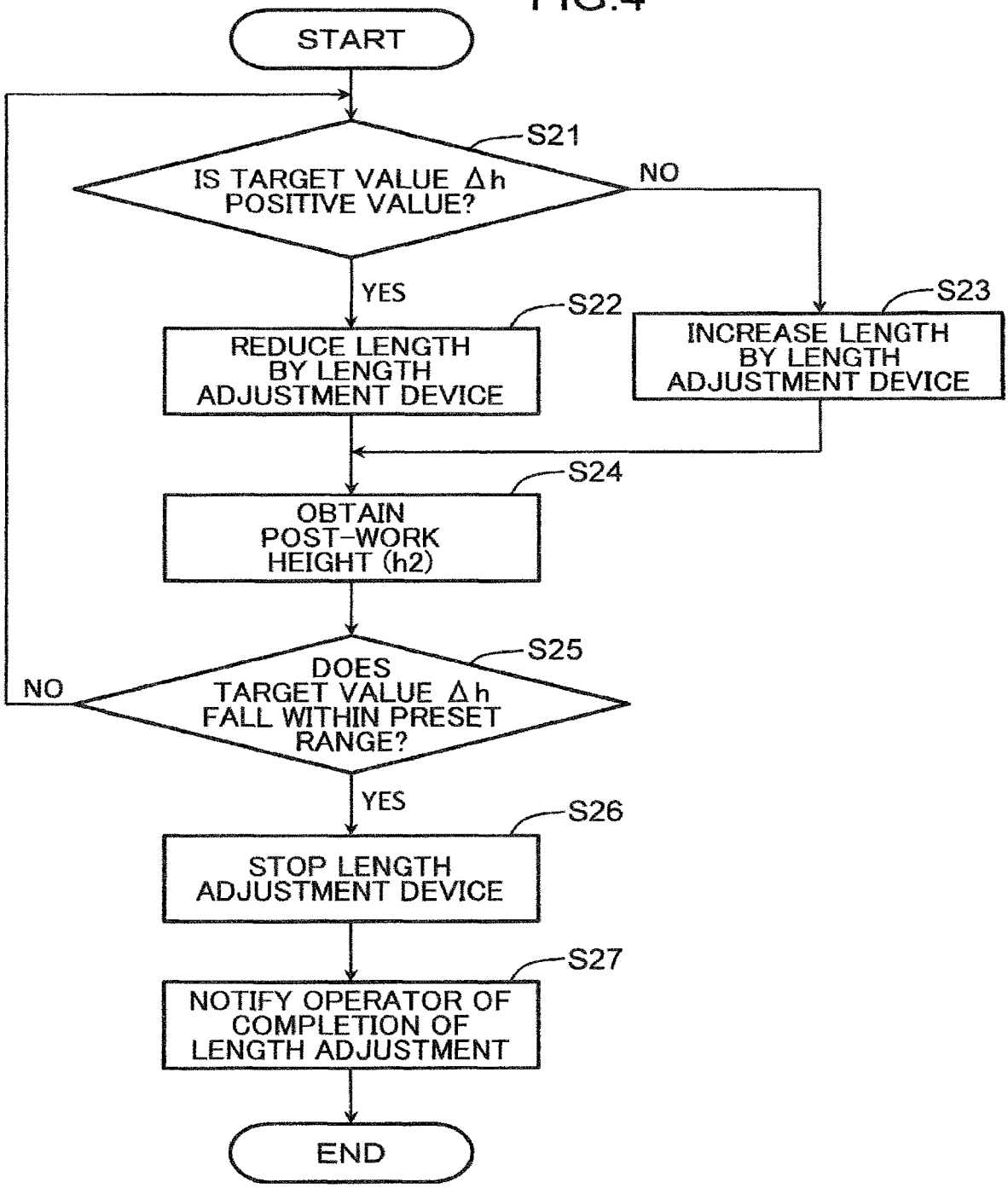
FIG. 4 is a flowchart depicting the details of automatic correction processing in the flowchart of FIG. 3.

FIG. 4 is a flowchart depicting the details of the automatic correction processing (step S10) in the flowchart of FIG. 3.

In the automatic correction processing, as shown in FIG. 4, the drive control part 67 controls, based on the target value Δh stored in the storage part 61, the operation of the length adjustment device 72 so that the post-work height h2 approaches the initial height h1 (steps S21 to S23). Specifically, in a case where the length adjustment device 72 is the cylinder 72, the following control is carried out. To be specific, if the target value Δh (Δh=h1−h2) is a positive value (YES in step S21), then the drive control part 67 controls the operation of the cylinder 72 to shorten the cylinder 72 (step S22). On the other hand, if the target value Δh is a negative value (NO in step S21), then the drive control part 67 controls the operation of the cylinder 72 to lengthen the cylinder 72 (step S23).

Next, the control device 60 obtains a signal related to the height of the counterweight 30 from the ground G detected by the height detection part 51 (step S24), and stores data related to the signal as the post-work height h2 (post-work height h2 that has been corrected).

Next, the calculation part 62 calculates the post-correction target value Δh (h1−h2) based on the initial height h1 and the post-work height h2 that has been corrected, and the target value Δh is stored into the storage part 61. Then, the control device 60 determines whether the post-correction target value Δh (h1−h2) falls within a preset range (step S25). If the post-correction target value Δh (h1−h2) does not fall within the preset range (NO in step S25), then the processing of steps S21 to S25 is performed again.

On the other hand, if the post-correction target value Δh (h1−h2) falls within the preset range (YES in step S25), then the drive control part 67 controls the cylinder 72 so that the operation of the cylinder 72 stops (step S26). The control device 60 (notification part 63) then notifies the operator of completion of the control on the automatic correction (length adjustment) (step S27), and the automatic correction flow ends. In the automatic correction flow of FIG. 3, the notification part 63 may notify the operator of information regarding the target value Δh. In such a case, the notification part 63 can also notify continuously the operator of a process in which the target value Δh is gradually reduced by the length adjustment device 72.

The operation limitation part 69 limits the operation related to the suspended cargo 1 while the height of the counterweight 30 from the ground G is automatically corrected, and after the height of the counterweight 30 from the ground G is automatically corrected. After the height of the counterweight 30 from the ground G is automatically corrected, the operation limitation part 69 determines whether the operation related to the suspended cargo 1 is performed (step S12 of FIG. 3). The case where the operation related to the suspended cargo 1 is not performed means, for example, a case where the operating lever for operation related to the suspended cargo 1 is in the neutral position where the suspended cargo 1 is not operated. Further, the case where the operation related to the suspended cargo 1 is performed means, for example, a case where the operating lever for operation related to the suspended cargo 1 is in the operating position where the suspended cargo 1 is operated.

The operation limitation part 69 continues the limitation to the operation elated to the suspended cargo 1 in a case where the operation related to the suspended cargo 1 is performed after the automatic correction (YES in step S12). On the other hand, the operation limitation part 69 cancels (step S13) the limitation to the operation related to the suspended cargo 1 in a case where the operation related to the suspended cargo 1 is not performed after the automatic correction (NO in step S12).

Through the processing of the flow, the post-work height h2 has the same value as that of the initial height h1 or a value falling within a range preset with respect to the initial height h1.

After the post-work height h2 is returned to the initial height h1, when the operator performs operation for lowering the suspended cargo 1 and places the suspended cargo 1 on the ground G (when the entire suspended cargo 1 is grounded on the ground G), the crane 10 moves slightly rearward, in other words, the boom 14 and the mast 15 pivot slightly rearward around the base ends thereof. Along with this, the counterweight 30 moves downward from the position corresponding to the initial height h1 to contact the ground G.

Modified Example

The present invention is not limited to the embodiment described above. The present invention includes, for example, the following aspect.

In the embodiment described above, the case where the post-work height h2 is automatically corrected to the initial height h1 is exemplified; however, is not limited thereto, and the operator himself/herself can correct the post-work height h2 to the initial height h1.

In a case where the operator himself/herself makes the correction, it is only required that the height adjustment assistance device 50 includes, at least, the initial state determination part 64, the height detection part 51, the storage part 61, the calculation part 62, the notification part 63, and the length adjustment device 72. Specifically, in a case where the initial state determination part 64 determines that the suspended cargo 1 has been lifted from the ground G at the start of the lifting work, the storage part 61 stores, as the initial height h1, the height of the counterweight 30 from the ground G detected by the height detection part 51. The calculation part 62 calculates a target value Δh for correcting the height of the counterweight 30 from the ground G based on the initial height h1 and the post-work height h2 that is a height of the counterweight 30 from the ground G detected by the height detection part 51 after the lifting work is performed and before the suspended cargo 1 is placed on the ground G. Information regarding the target value Δh is notified to the operator by the notification part 63. The operator thus operates the length adjustment device 72 with the information regarding the notified target value Δh used as an indicator for length adjustment, and thereby can adjust the length from the tip 15A of the mast 15 to the counterweight 30. Thereby, the operator can easily correct the post-work height h2 to the initial height h1 by crane operation on his/her own.

Thus, in the configurations according to the embodiment described with reference to FIGS. 2 to 4, the configurations other than the initial state determination part 64, the height detection part 51, the storage part 61, the calculation part 62, the notification part 63, and the length adjustment device 72 are not essential configurations and may be omitted.

As described above, even in a case where the post-work height that is the height of the counterweight from the ground after lifting work is different from the initial height, a height adjustment assistance device that assists in adjusting the post-work height to reduce the burden of crane operation by the operator, a crane provided with the height adjustment assistance device, and a height adjustment method can be provided.

(1) There is provided a height adjustment assistance device for assisting in adjusting a height of a counterweight, from a ground, suspended from a tip of a mast of a crane after lifting work for a suspended cargo suspended from the crane. The height adjustment assistance device includes an initial state determination part, a height detection part, a storage part, a calculation part, a notification part, and a length adjustment device. The initial state determination part determines whether the suspended cargo has been lifted from the ground at a start of the lifting work. The height detection part detects the height of the counterweight from the ground. The storage part stores, as an initial height, the height of the counterweight from the ground detected by the height detection part when the initial state determination part determines that the suspended cargo has been lifted. The calculation part calculates a target value for correcting the height of the counterweight from the ground based on the initial height stored in the storage part and a post-work height that is the height of the counterweight from the ground detected by the height detection part after the lifting work is performed and before the suspended cargo is placed on the ground. The notification part is configured to notify an operator of information regarding the target value. The length adjustment device is configured to adjust a length extending from the tip of the mast to the counterweight.

In the height adjustment assistance device, a height of the counterweight from the ground detected, by the height detection part, when the initial state determination part determines that the suspended cargo has been lifted from the ground at the start of the lifting work, in other words, when the suspended cargo suspended from a jib member of the crane is floated from the ground and the counterweight suspended from the tip of the mast is floated from the ground is stored into the storage part as the initial height. The calculation part calculates a target value for correcting the height of the counterweight from the ground based on the initial height and the post-work height that is a height of the counterweight from the ground detected by the height detection part after the lifting work is performed and before the suspended cargo is placed on the ground. Information regarding the target value is notified to the operator by the notification part. The jib member includes only the boom 14 according to the embodiment in one case, and the jib member includes the boom 14 and at least one auxiliary jib connected to the tip of the boom 14 in another case.

The operator himself/herself may operate the crane to correct the height of the counterweight from the ground, or the height adjustment assistance device may make the correction automatically.

In a case where the operator himself/herself operates the crane to correct the height of the counterweight from the ground, the information regarding the target value notified is used as an indicator for length adjustment to operate the length adjustment device, so that the length from the tip of the mast to the counterweight can be adjusted. This makes it possible to easily return the height of the counterweight from the ground after the lifting work to the initial height.

After the correction by the operator or the automatic correction by the height adjustment assistance device, it is possible to avoid a state where the counterweight does not contact the ground and a state where a guy line for supporting the counterweight becomes loose when the operator lowers the suspended cargo and the suspended cargo is placed on the ground (when the entire suspended cargo is grounded on the ground). As described above, in the height adjustment assistance device, it is possible to assist in adjusting the post-work height even in a case where the post-work height is different from the initial height, which reduces the burden of crane operation by the operator.

Further, since the length adjustment device adjusts the length from the tip of the mast to the counterweight, it is not necessary to change the angle of the mast in correcting the post-work height to the initial height. This enables correcting the post-work height while a change is avoided in balance of the entire crane due to the change in angle of the mast.

(2) The height adjustment assistance device preferably further includes a suspended cargo movement detection part which detects operation for adjusting a height of the suspended cargo from the ground, a load detection part which detects a load applied, by the suspended cargo, to a tip of the jib member, and a post-work height identifying part which identifies, as the post-work height, the height of the counterweight from the ground detected by the height detection part when a condition that the suspended cargo movement detection part detects operation for reducing the height of the suspended cargo from the ground and the load detection part detects reduction in load related to the suspended cargo is satisfied, and the calculation part is configured to calculate the target value based on the initial height and the post-work height when the post-work height identifying part identifies the post-work height.

The configuration enables the height adjustment assistance device to automatically identify the post-work height. The details are as follows. To be specific, conditions under which the post-work height identifying part identifies the post-work height include: detecting, by the suspended cargo movement detection part, operation for reducing the height of the suspended cargo from the ground; and detecting, by the load detection part, reduction in load related to the suspended cargo. A case where both the conditions are detected shows a high possibility that the operator intends to move the suspended cargo downward and it is a moment when a part of the suspended cargo (corner of the suspended cargo or the like) comes into contact with the ground and the suspended cargo has not yet been placed on the ground (state before the entire suspended cargo is grounded on the ground). Thus, when both the conditions are satisfied, the post-work height identifying part can identify the post-work height, namely, the height of the counterweight from the ground detected by the height detection part after the lifting work is performed and before the suspended cargo is placed on the ground. The calculation part then calculates the target value based on the post-work height identified by the post-work height identifying part and the initial height.

Note that, as described above, after the height adjustment assistance device automatically identifies the post-work height and the calculation part calculates the target value, correcting the height of the counterweight from the ground may be performed by the operator himself/herself through crane operation, or, alternatively, may be performed automatically by the height adjustment assistance device as described below.

(3) The height adjustment assistance device preferably further includes a drive control part which controls drive of the length adjustment device based on the target value to automatically correct the height of the counterweight from the ground.

The configuration enables the height adjustment assistance device to automatically adjust the post-work height after the lifting work. This eliminates the need for the operator to perform crane operation for adjusting the post-work height. This can further reduce the burden on an operator who is not familiar with the crane operation or an operator who would like to focus on operation for lowering the suspended cargo.

(4) The height adjustment assistance device may further include a necessity determination part which determines, based on the target value, whether correcting the height of the counterweight from the ground is necessary, in which the drive control part may be configured to control the drive of the length adjustment device based on the target value only in a case where the necessity determination part determines that correcting the height of the counterweight from the ground is necessary.

According to the configuration, the drive control part controls drive of the length adjustment device only when the necessity determination part determines that correcting the height of the counterweight from the ground is necessary based on the target value, and therefore, the control flow of the height adjustment assistance device can be simplified.

(5) In the height adjustment assistance device, the necessity determination part is preferably configured to determine that correcting the height of the counterweight from the ground is necessary only in a case where a difference between the initial height and the post-work height does not fall within a preset range.

According to the configuration, the necessity determination part determines that correcting the height of the counterweight from the ground is necessary only in a case where the difference between the initial height and the post-work height does not fall within a preset range as described above. On the other hand, in a case where the difference between the initial height and the post-work height falls within the preset range, in other words, the difference therebetween falls within an acceptable range, the necessity determination part determines that correcting the height of the counterweight from the ground is not necessary, and the drive control part does not control the drive of the length adjustment device. Providing a certain extent of conditions for determination of the necessity of correction avoids excessive control operation, leading to the reduction in time required for the height adjustment.

(6) The height adjustment assistance device preferably further includes an operation stop part which stops, before the automatic correction, operation related to the suspended cargo.

According to the configuration, since the operation stop part stops the operation related to the suspended cargo before the automatic correction, it is possible to maintain the position of the suspended cargo in a state where the post-work height identifying part identifies the post-work height, in other words, in a state corresponding to a moment when a part of the suspended cargo comes into contact with the ground and the suspended cargo has not yet been placed on the ground (state before the entire suspended cargo is grounded on the ground). With the state maintained, further automatic correction to the post-work height is made. Thus, it is possible to avoid a situation where the suspended cargo is placed on the ground (situation where the entire suspended cargo is grounded on the ground), for example, during the correction to the post-work height, so that the automatic correction is made more safely.

(7) The height adjustment assistance device may further include an input part which receives, from the operator, an input as to whether the automatic correction is necessary, in which the drive control part may be configured to control the drive of the length adjustment device based on the target value in a case where the input part receives an input that the automatic correction is necessary.

According to the configuration, the operator can select whether to make correction to the post-work height by himself/herself or to cause the height adjustment assistance device to make automatic correction thereto.

(8) The height adjustment assistance device preferably further includes an operation limitation part which limits the operation related to the suspended cargo while the automatic correction is carried out, and after the automatic correction is carried out.

According to the configuration, since the operation limitation part limits the operation related to the suspended cargo during and after the automatic correction, it is possible to prevent the suspended cargo from moving in a manner different from the operator's expectation after the automatic correction. This enables safer automatic correction to the post-work height.

(9) In the height adjustment assistance device, the operation limitation part may be configured to cancel the limitation to the operation related to the suspended cargo in a state where after the automatic correction is carried out and the operation related to the suspended cargo is not performed.

According to the configuration, in a case where the operation related to the suspended cargo is not performed after the automatic correction, specifically, for example, in a case where the operating lever for operation related to the suspended cargo is in the neutral position where the suspended cargo is not operated, the operation limitation part cancels the limitation to the operation related to the suspended cargo. It is, therefore, possible to reliably prevent, by simple control, the suspended cargo from moving in a manner different from the operator's expectation after the automatic correction.

(10) A crane includes a lower traveling body, an upper slewing body mounted on the lower traveling body so as to be slewable, a boom attached to the upper slewing body so as to be raisable and lowerable, a mast that is attached to the upper slewing body and supports the boom in rearward, a counterweight suspended from a tip of the mast, and the height adjustment assistance device for assisting in adjusting a height of the counterweight from the ground.

The crane can assist in adjusting the post-work height even in a case where the post-work height that is a height of the counterweight from the ground after lifting work is different from the initial height, leading to reduction of the burden required for the operator to perform the crane operation.

(11) A height adjustment method is a method for adjusting a height of a counterweight, from a ground, suspended from a tip of a mast of a crane through a hanging member after lifting work for a suspended cargo suspended from a jib member of the crane. The height adjustment method includes detecting an initial height that is the height of the counterweight from the ground at a start of the lifting work, detecting a post-work height that is the height of the counterweight from the ground after the lifting work is performed and before the suspended cargo is placed on the ground, deter mining a target value for correcting the height of the counterweight from the ground based on the initial height and the post-work height, and adjusting, based on the target value, the height of the counterweight from the ground by adjusting a length of the hanging member extending from the tip of the mast to the counterweight.

According to the height adjustment method, it is possible to assist in adjusting the post-work height even in a case where the post-work height that is a height of the counterweight from the ground after lifting work is different from the initial height, leading to reduction of the burden required for the operator to perform the crane operation.

The invention claimed is:

1. A height adjustment assistance device for assisting in adjusting a height of a counterweight, from a ground, suspended from a tip of a mast of a crane through a hanging member after lifting work for a suspended cargo suspended from a jib member of the crane, the height adjustment assistance device comprising:

an initial state determination part which determines whether the suspended cargo has been lifted from the ground at a start of the lifting work;

a height detection part which detects the height of the counterweight from the ground;

a storage part which stores, as an initial height, the height of the counterweight from the ground detected by the height detection part when the initial state determination part determines that the suspended cargo has been lifted;

a calculation part which calculates a target value for correcting the height of the counterweight from the ground based on the initial height stored in the storage part and a post-work height that is the height of the counterweight from the ground detected by the height detection part after the lifting work is performed and before the suspended cargo is placed on the ground;

a notification part configured to notify an operator of information regarding the target value; and a length adjustment device configured to adjust a length of the hanging member by operating in a manner to change the length of the hanging member extending from the tip of the mast to the counterweight.

2. The height adjustment assistance device according to claim 1, further comprising a suspended cargo movement detection part which detects operation for adjusting a height of the suspended cargo from the ground, a load detection part which detects a load applied, by the suspended cargo, to a tip of the jib member, and a post-work height identifying part which identifies, as the post-work height, the height of the counterweight from the ground detected by the height detection part when a condition that the suspended cargo movement detection part detects operation for reducing the height of the suspended cargo from the ground and the load detection part detects reduction in load related to the suspended cargo is satisfied, wherein the calculation part is configured to calculate the target value based on the initial height and the post-work height when the post-work height identifying part identifies the post-work height.

3. The height adjustment assistance device according to claim 2, further comprising a drive control part which controls drive of the length adjustment device based on the target value to automatically correct the height of the counterweight from the ground.

4. The height adjustment assistance device according to claim 3, further comprising a necessity determination part which determines, based on the target value, whether correcting the height of the counterweight from the ground is necessary, wherein the drive control part is configured to control the drive of the length adjustment device based on the target value only in a case where the necessity determination part determines that correcting the height of the counterweight from the ground is necessary.

5. The height adjustment assistance device according to claim 4, wherein the necessity determination part is configured to determine that correcting the height of the counterweight from the ground is necessary only in a case where a difference between the initial height and the post-work height does not fall within a preset range.

6. The height adjustment assistance device according to claim 3, further comprising an operation stop part which stops, before the automatic correction, operation related to the suspended cargo.

7. The height adjustment assistance device according to claim 3, further comprising an input part which receives, from the operator, an input as to whether the automatic correction is necessary, wherein the drive control part is configured to control the drive of the length adjustment device based on the target value in a case where the input part receives an input that the automatic correction is necessary.

8. The height adjustment assistance device according to claim 3, further comprising an operation limitation part which limits the operation related to the suspended cargo while the automatic correction is carried out, and after the automatic correction is carried out.

9. The height adjustment assistance device according to claim 8, wherein the operation limitation part is configured to cancel the limitation to the operation related to the suspended cargo in a state where the operation related to the suspended cargo is not performed after the automatic correction is carried out.

10. A crane comprising:

a lower travelling body;

an upper slewing body mounted on the lower travelling body so as to be slewable;

a boom attached to the upper slewing body so as to be raisable and lowerable;

a mast that is attached to the upper slewing body and supports the boom in rearward;

a counterweight suspended from a tip of the mast; and the height adjustment assistance device according to claim 1.

11. A height adjustment method for adjusting a height of a counterweight, from a ground, suspended from a tip of a mast of a crane through a hanging member after lifting work for a suspended cargo suspended from a jib member of the crane, the height adjustment method comprising:

detecting an initial height that is the height of the counterweight from the ground at a start of the lifting work;

detecting a post-work height that is the height of the counterweight from the ground after the lifting work is performed and before the suspended cargo is placed on the ground;

determining a target value for correcting the height of the counterweight from the ground based on the initial height and the post-work height; and adjusting, based on the target value, the height of the counterweight from the ground by adjusting a length of the hanging member extending from the tip of the mast to the counterweight.

* * * * *